United States Patent [19]

Halm

[11] 4,100,060

[45] Jul. 11, 1978

[54] INDEX CARD REGISTER WITH SELECTOR DEVICE

[75] Inventor: Hans Halm, Herne, Germany

[73] Assignee: Firma Niveau AG, Basel, Switzerland

[21] Appl. No.: 760,260

[22] Filed: Jan. 18, 1977

[30] Foreign Application Priority Data

Oct. 19, 1976 [DE] Fed. Rep. of Germany ..... 2647067

[51] Int. Cl.[2] ..... B07C 5/00

[52] U.S. Cl. ..... 209/80.5

[58] Field of Search ..... 209/80.5, 110.5

[56] References Cited

U.S. PATENT DOCUMENTS

| | | | |
|---|---|---|---|
| 1,188,783 | 6/1916 | Honecker | 209/80.5 |
| 1,876,149 | 9/1932 | Oakley | 209/110.5 |
| 2,640,485 | 6/1953 | Zalkind | 209/110.5 |
| 3,664,500 | 5/1972 | Krebs | 209/80.5 |

FOREIGN PATENT DOCUMENTS

| | | | |
|---|---|---|---|
| 494,207 | 4/1927 | Fed. Rep. of Germany | 209/80.5 |

*Primary Examiner*—Allen N. Knowles
*Assistant Examiner*—Joseph J. Rolla
*Attorney, Agent, or Firm*—Toren, McGeady and Stanger

[57] ABSTRACT

A compact index card register of relatively small dimensions, consisting of a housing with a keyboard of several selector keys arranged in an array of rows and columns, and within the housing a drawer adapted to be moved outwardly from the housing and to accommodate a stack of index cards. Parts associated with each selector key and the housing serve to retain a predetermined number of index cards within the housing and to release the drawer for outward movement whereby all but the predetermined number of index cards are moved outwardly together with the drawer, in exposing to sight an index card corresponding to the actuated selector key. Every index card includes a selector tongue with a predetermined number of selector apertures.

11 Claims, 20 Drawing Figures

FIG. 9
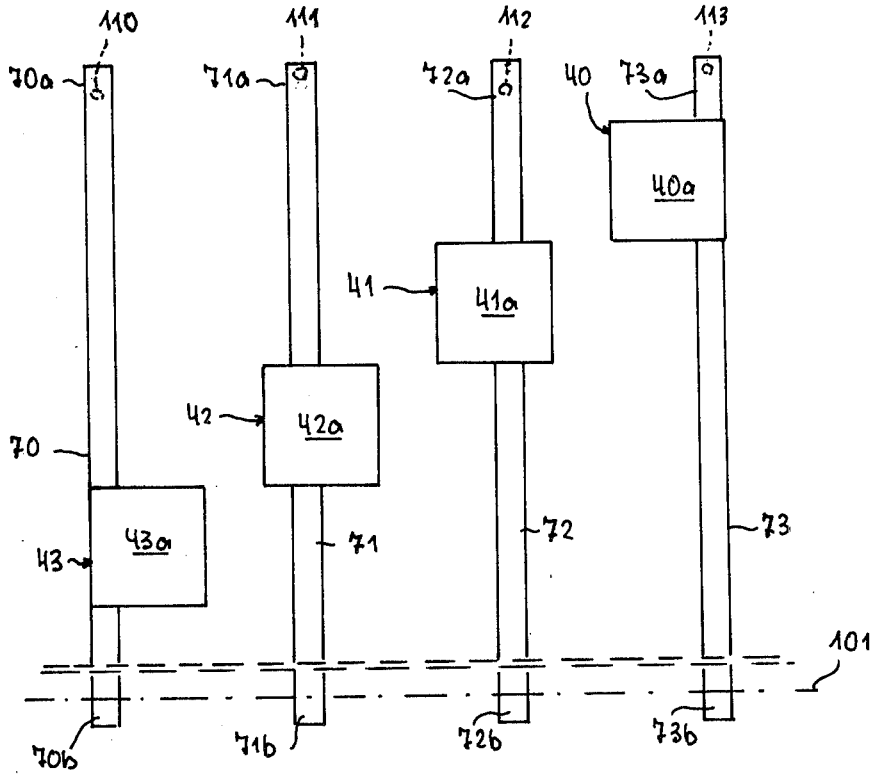
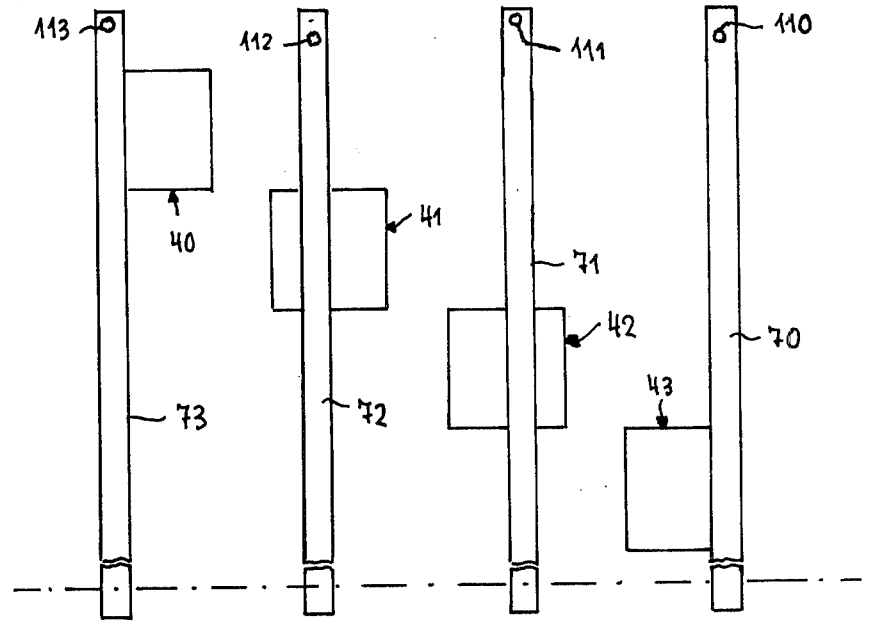
FIG. 10

FIG. 14
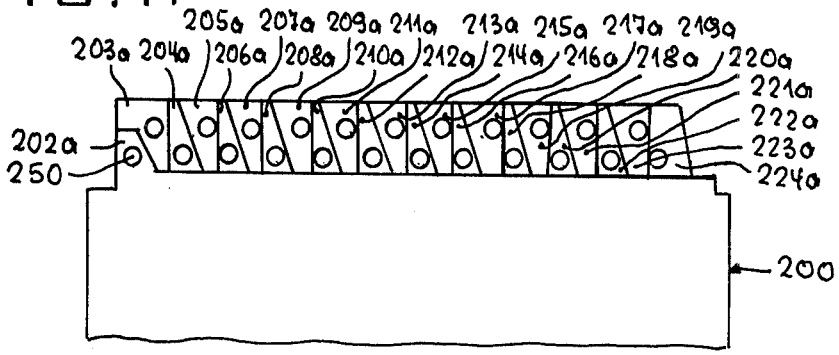
FIG. 15
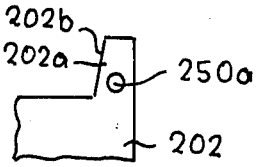
FIG. 16
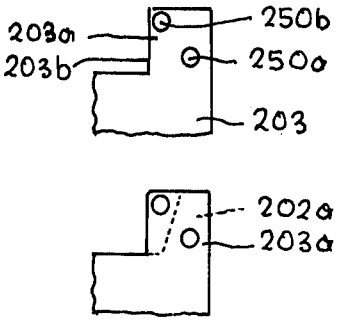
FIG. 17
FIG. 18
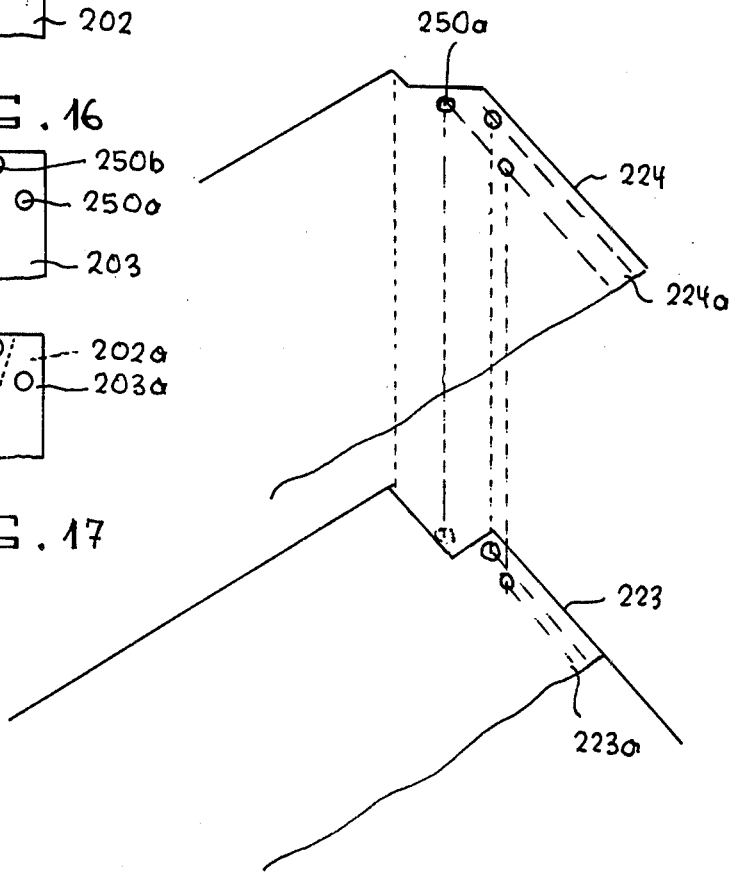

INDEX CARD REGISTER WITH SELECTOR DEVICE

The present invention relates to an index card register with selector means, including a housing consisting of a cover member and a bottom member, a plurality of selector keys, a drawer biased by a compression spring and adapted to be locked by a locking mechanism, a plurality of index cards defining a replaceable stack of index cards accommodated within the drawer, the index cards including marginal cut-outs, means for unlocking the drawer and exposing to sight of the user an index card selected by actuation of a corresponding selector key, by unlocking the drawer and moving the same into a position projecting from the housing under the bias of the compression spring, the drawer including entrainment cams of a resilient material adapted to engage entrainment apertures of the index cards, the index cards including selector apertures adapted to be engaged by the counterspring-biased selector keys.

There are already known various widely differing types of index card registers with selector devices. These heretofore known registers include generally a housing for receiving a stack of loosely inserted index cards, and a keyboard wherein the keys are provided with suitable indicia. By actuation of the keys desired cards may be selected. The index cards may bear in an alphabetical sequence any type of desired data or notes that are to be kept readily accessible for reference purposes. One heretofore known index card register is of a relatively flat configuration when closed and may be opened by means of a number of manually actuated keys by which the index card register may be opened in a desired position to expose to sight the data that have previously been recorded on the index cards. This index card register also includes a locking key by means of which the cover member adapted to cover the index cards may be moved into the closed position. When the cover member is closed, simultaneously all of the raised index cards are automatically returned into their initial lying position.

In another heretofore known type of index card register the housing includes a drawer that is biased by a compression spring and is adapted to be closed by a key-bolt. The drawer serves to receive the index cards. This heretofore known index card register furthermore comprises means for unlocking the drawer and exposing to sight an index card that has been selected by actuation of a corresponding selector key, by unlocking the drawer and moving the same into a position in which the drawer projects from the housing. This outward movement is effected under the bias of the compression spring.

These prior art index card registers are table type devices and are employed in a position in which they lie flat on a supporting surface. The housings of the index card registers may also have the form of a base member for supporting a telephone apparatus when the housing of the card register includes a drawer for moving the selected index cards outwardly from the housing.

A common feature of all heretofore known index card registers is that the multi-key keyboard is arranged in a forward portion of the index card register, and the keys are arranged in a row, i.e. side by side. The heretofore known index card registers, moreover, are of relatively large dimensions.

It is an object of the present invention to provide a novel and improved index card register of minimum dimensions.

It is another object of the present invention to provide an index card register in which the area covered by the selector keys approximately corresponds to the base surface of the index card register.

It is still another object of the present invention to provide an index card register that may be assembled from a minimum of parts.

It is still another object of the present invention to provide an index card register that may be manufactured and assembled at low cost.

In accordance with the present invention, these and further objects are achieved in an index card register by a plurality of selector keys arranged in several rows and columns on the cover member, each selector key being mounted on one end of an associated one-armed pivot lever, the other end of the pivot lever being rotatably journalled on a mounting rod serving as a pivot axis, the mounting rod being disposed in a forward region of the housing, the pivot lever being held in a substantially horizontal position by resilient means and includes, at its free end, a card retainer pin depending in a downward direction toward the bottom wall of the housing bottom member, the card retainer pins of the pivot levers being arranged in two rows along the lower surfaces of the pivot levers whereby the card retainer pins of every other pivot lever define a row; a drawer detent bar resiliently mounted in a rearward region of the bottom wall of the housing bottom member, the drawer detent bar including a drawer locking mechanism adapted to be unlocked to permit outward movement of the drawer when being biased by the card retainer pin of a depressed selector key; selector tongues with apertures for the card retainer pins along rearward marginal portions of the index cards disposed in a stack within the drawer, the selector tongues increasing in extension by step-like increments from a lowermost index card having one aperture up to an uppermost index card having a highest number of apertures, from a bottom right hand position to a top left hand position, i.e. across the stack of cards, the number of apertures in the selector tongues increasing from the lowermost index card to the uppermost index card by one for each card, whereby the incremental one aperture in each index card as compared to the apertures in an adjacent underlying index card is exposed with respect to the aperture-containing selector tongue portions of an adjacent underlying index card, and a triangular entrainment cam in a forward region of the drawer, the entrainment cam adapted to cooperate with entrainment apertures in a forward region of the index cards.

An index card register which is arranged as above defined is of minimum dimensions, due to the arrangement of the selector keys in rows and columns since the area covered by the selector keys is only slightly smaller than the base surface of the card register housing. By this expedient the overall dimensions of the index card register may be minimized. By employing one-armed pivot levers that are rigidly connected to the associated selector keys the assembly operation is reduced to assembling a few parts only. Moreover, operational reliability of the index card register is ensured since by employing resilient means at the rear wall of the card register housing each pivot lever is being held in a position in which the free ends of the card retainer pins are above the stack of index cards. Any incorrect operation is excluded since when actuating a selector key the card retainer pin associated with the actuated selector key is being inserted into the associated apertures of the index cards in the stack of index cards and thus the pin operates the drawer locking mechanism which when actuated unlocks the drawer so that during the outward movement of the drawer the card retainer pin of the actuated selector key retains all of those index cards in the stack of cards that overlie the selected index card. An additional advantage is that the selector tongues of the index cards provided with the apertures are arranged in a rearward marginal portion of the index cards so that when removing the index cards for writing thereon any adamage to the selector tongues is avoided.

The means for supporting the free ends of the card retainer pins depending from the free ends of the pivot levers in a position above the uppermost index card in the stack of index cards and thereby above the apertures of the index cards consists of a plurality of resilient tongues mounted at the rear wall of the housing bottom member, the pivot levers being supported at their free ends by these tongues.

The drawer locking mechanism includes the drawer detent bar disposed in the path of movement of the drawer, the drawer detent bar being pivotably mounted about a horizontal pivot axis in the vicinity of the rear wall of the housing bottom member, a forward portion of the drawer detent bar being movable in an aperture, a recess or the like in the bottom wall of the drawer, the drawer detent bar being resilient and adapted to be retained in a locking position and further includes a central retaining cam in the landing region of the drawer, and a lug in a bottom rear portion of the drawer, the lug being adapted to engage the retainer cam.

The selector keys consist of square or rectangular tabs, each of which is connected by a vertical web to an associated pivot lever. The width of every of four selector keys disposed in a column corresponds substantially to the width of the four pivot levers supporting these selector keys. Due to this unique configuration the selector keys may be arranged in rows and columns in defining a virtually continuous surface array so that the selector keys may be accommodated in a minimum of space. The four selector keys in a column are connected to their associated pivot levers in a manner whereby the rearward selector key is cantilevered toward the left side, and the forward selector key is cantilevered toward the right side with respect to its associated pivot lever, and the two intermediate selector keys are connected to their associated pivot levers in a manner whereby all of the four selector keys are aligned in a column. In this arrangement the rearward selector key of four selector keys defining a column unit includes a portion cantilevered to the left, and the forward selector key includes a portion cantilevered to the right whereby each of these two cantilevered portions is of a width substantially corresponding to the width of three pivot levers, and the two selector keys disposed between rearward and forward selector keys each include on one side a cantilevered portion of a width substantially corresponding to the width of a pivot lever, and on the other side a cantilevered portion of a width substantially corresponding to the width of two pivot levers.

According to a further characteristic, the top cover plate of the housing cover member may include an aperture the size and dimensions of which substantially correspond to the area covered by the array of selector keys.

In the following, the invention will be described more in detail with reference to a preferred embodiment shown in the appended drawings wherein FIG. 1 is a top view of an index card register comprising bottom and cover members in accordance with the present invention;

FIG. 9 is a top view of the four selector keys of FIG. 8 disposed in laterally spaced positions;

FIG. 10 is a bottom view of the selector keys of FIG. 9;

FIG. 14 is a fragmentary bottom view of a stack of index cards and showing the aperture-containing selector tongues at the rearward portions of the index cards;

FIG. 15 is a fragmentary top view of the lowermost index card and showing the selector tongue with one aperture;

FIG. 16 is a fragmentary top view of the index card overlying the lowermost index card and showing the selector tongue with two apertures;

FIG. 17 is a fragmentary top view of the two index cards of FIGS. 15 and 16 in an overlying position; and FIG. 18 is an exploded fragmentary perspective view of the two index cards of FIGS. 15 and 16.

Figure 1:
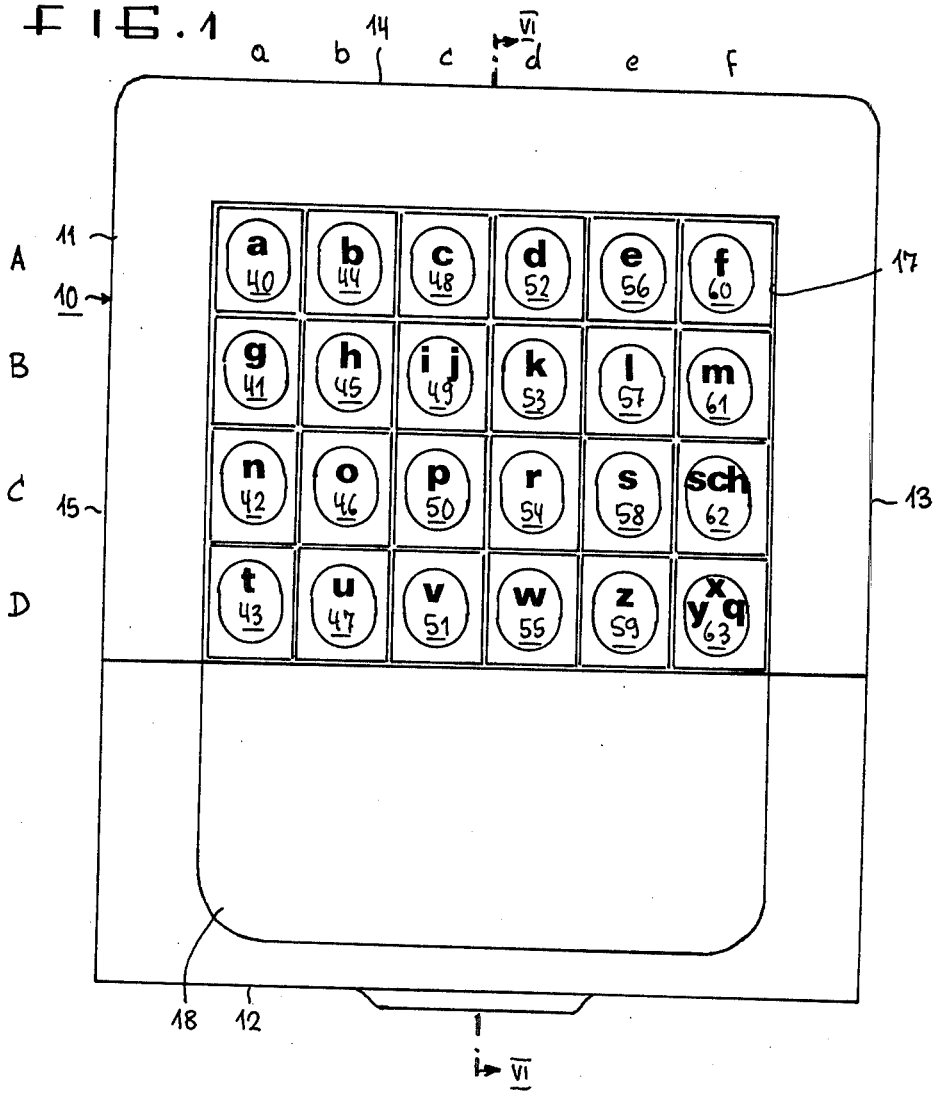
Figure 2:
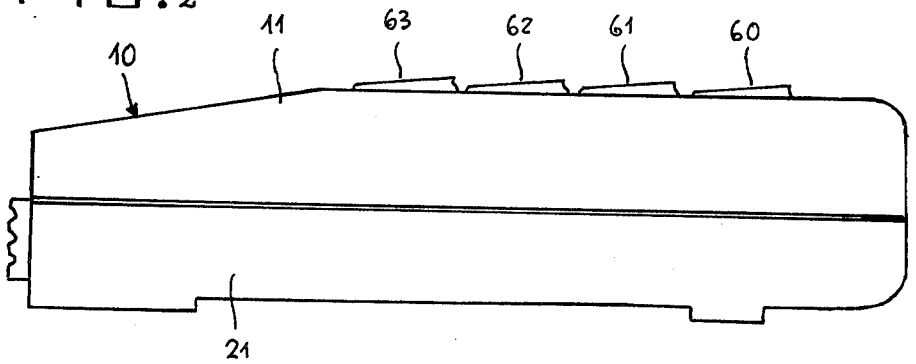
FIG. 2 is a lateral elevational view of the index card register.
Figure 3:
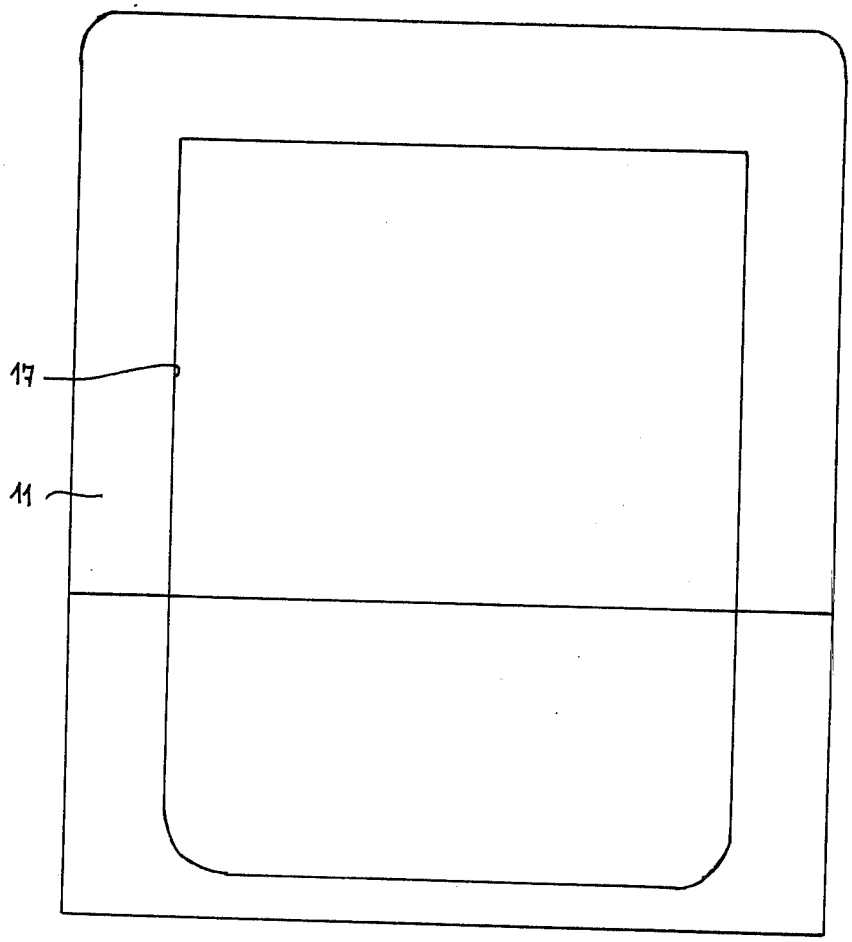
FIG. 3 is a top view of the cover member.
Figure 5:
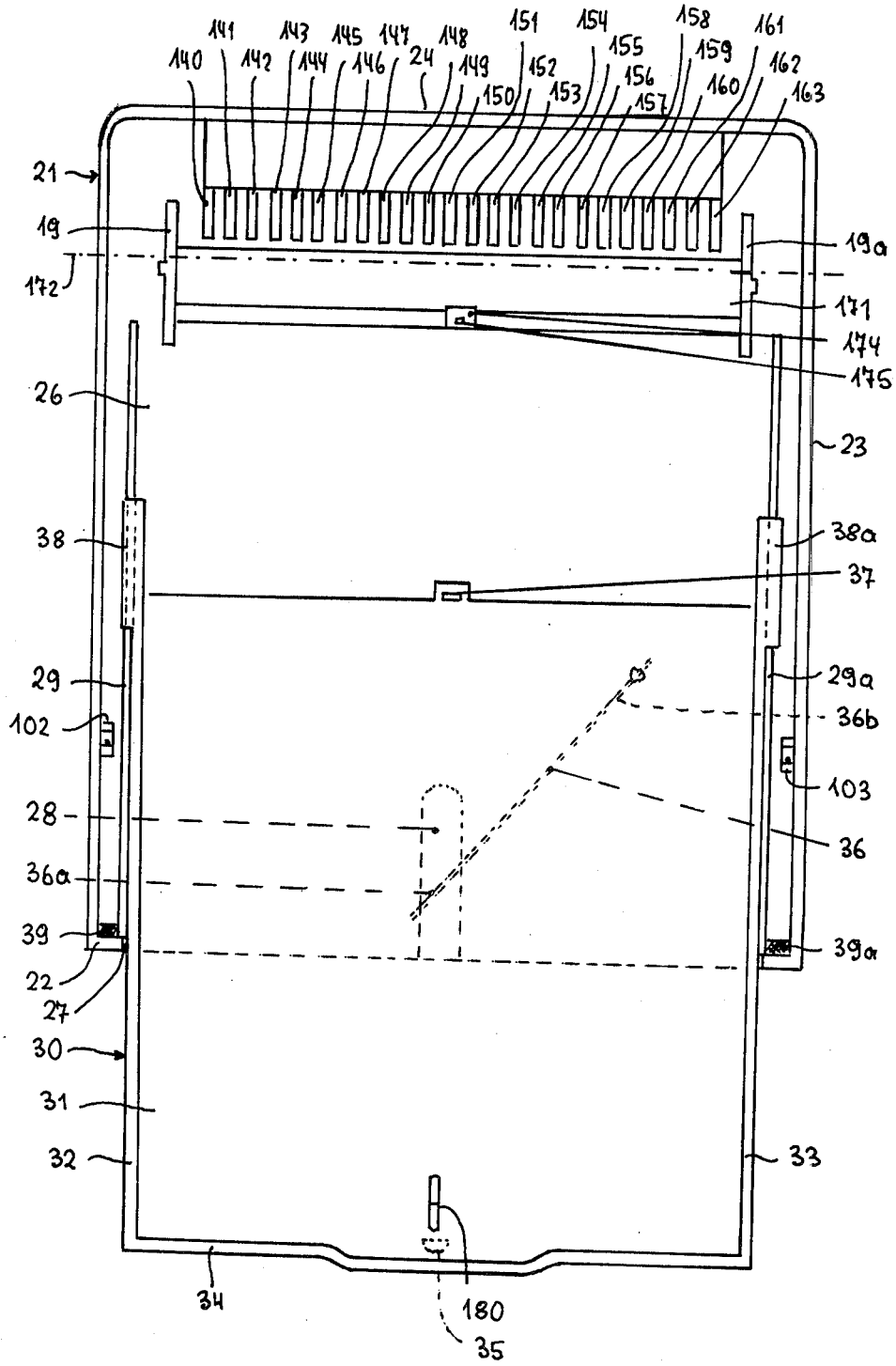
FIG. 5 is a top view of the index card register after removal of the cover member whereby the drawer is in a position in which it partly projects from the housing.
Figure 7:
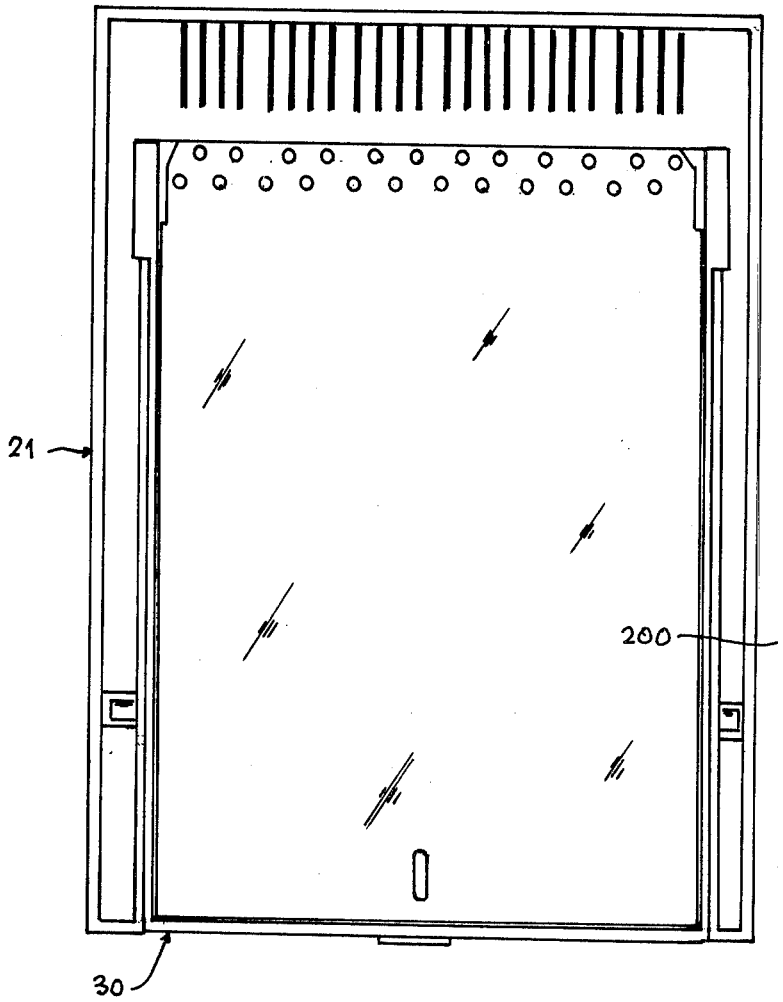
FIG. 7 is a top view of the index card register whereby the cover member is removed, and showing a stack of cards disposed within the drawer.

Referring to FIGS. 1, 2 and 5 the index card register of the present invention is shown approximately in original size. The index card register includes a housing 10 with a box-shaped cover member 11 and a likewise box-shaped bottom member 21. The cover member 11 and the bottom member 21 are mutually interconnected by means such as screws or adhesive attachments (not shown), and are preferably made of a suitable plastic material. The cover member 11 includes the side walls 13, 15, a front wall 12 and a rear wall 14, as well as a top cover plate 16 in which is cut out a square or generally rectangular aperture 17. The portion of the top cover plate 16 facing the front wall 12 of the cover member 11 is inclined and may be provided with a tray-shaped recess (not shown) for receiving writing utensils or the like.

The bottom member 21 includes the side walls 23, 24, a front wall 22, a rear wall 25 and a bottom wall 26. A slot-shaped aperture 27 in the front wall 22 serves to receive a drawer 30. The bottom member 21 furthermore includes spaced guide bars 29, 29*a* that extend in a direction parallel to the side walls 23, 24. Angle-shaped retaining ledges 19, 19*a* are disposed in a rearward region of the bottom member 21 and in the vicinity of the guide bars 19, 29*a*. These retaining ledges 19, 19*a* are arranged in the path of movement of the drawer 30 and overlie partly a stack of index cards 200 accommodated within the drawer 30 to hold the stack in the desired height and secure the index cards against lift-off (see FIGS. 5 and 6).

The bottom member 21 of the housing 10 receives the drawer 30 which consists of a bottom wall 31, the side walls 32, 33 and a front wall 34 interconnecting the front ends of the two side walls so that the drawer 30 is open at its rear end.

Alternately, the drawer may be guided differently within the bottom member 21. Thus the bottom wall 31 of the drawer may be provided with a web engaging a groove in the bottom wall of the bottom member 21. A dove-tail shaped cross-sectional profile may be used to prevent any undesired lift-off of the drawer from the bottom member. The bottom wall 31 of the drawer 30 includes at its front bottom end a cam 35. This cam 35 is adapted to engage a groove-shaped recess 28 in the bottom wall 26 of the bottom member 21 when pushing the drawer into the housing 10. This groove-shaped recess 28 extends from the front edge of the bottom wall 26 of the bottom member 21 and is arranged centrally in the bottom wall 26. A steel spring rod 36 is arranged in the region of this groove-shaped recess 28 so that its free end 36*a* is within the area of the groove-shaped recess 28 whereas the opposite end 36*b* of the steel spring rod 36 is rigidly connected to the bottom wall 26 of the bottom member 21. The action of the steel spring rod 36 corresponds to the action of a thrust spring which is biased by moving the drawer 30 into the bottom member 21 of the housing 10 so that when unlocking the drawer 30 the drawer may be driven outwardly by means of the steel spring rod 36 which resiliently returns into its initial position (FIG. 5).

Figure 4:
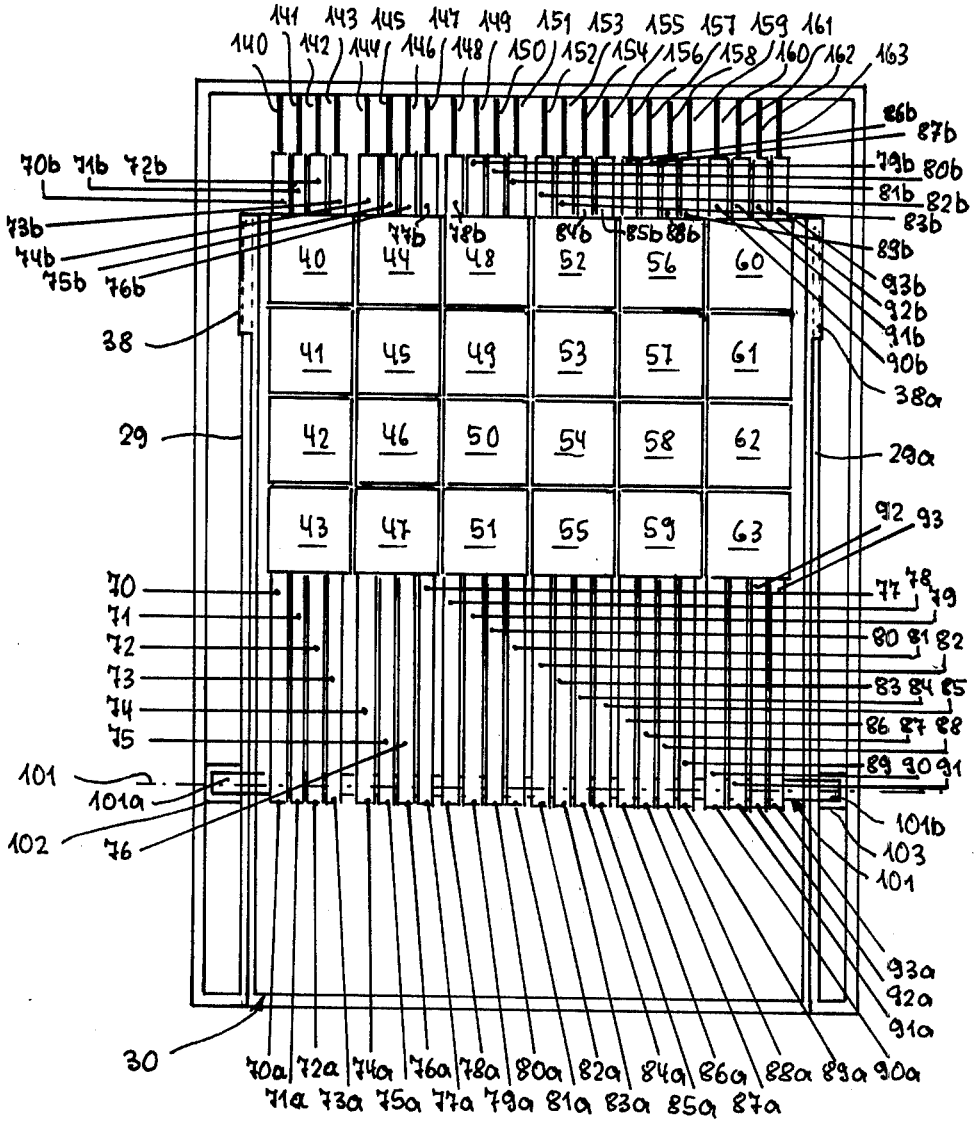
FIG. 4 is a top view of the index card register whereby the cover member has been removed.

The bottom wall 31 of the drawer 30 furthermore includes in its rearward portion a central lug 37 constituting one member of a drawer locking mechanism 170 described further below. Along rear portions of the side walls 32, 33 of the drawer are arranged guiding detents 38, 38*a* that project from the upper edges of the side walls 32, 33 and are cantilevered in lateral directions in overlying the guide bars 29, 29*a* that are molded integrally with the bottom wall 26 of the bottom member 21. These guiding detents 38, 38*a* simultaneously serve to delimit the path of outward movement of the drawer 30 (FIGS. 4 and 5). Resilient buffer elements 39, 39*a* made of felt or the like at the inner surfaces of the two parts of the side wall 22 and on both sides of the aperture 27 in the bottom member 21 and in the path of movement of the guiding detents 38, 38*a* serve simultaneously to delimit the path of movement of drawer movement. Alternately, the path of outward movement of the drawer 30 may likewise be delimited by means of suitable devices of a different design.

A plurality of selector keys of a square or rectangular configuration are arranged within the aperture 17 of the top cover plate 16 of the cover member 11. The selector keys are arranged in an array substantially covering the entire surface of the aperture 17 in the cover member 11.

In the embodiment shown in FIG. 1 there are provided twenty four selector keys 40, 41, 42, 43, 44, 45, 46, 47, 48, 49, 50, 51, 52, 53, 54, 55, 56, 57, 58, 59, 60, 61, 62 and 63. These selector keys may bear suitable indicia such as letters of the alphabet.

The selector keys 40 and 63 are connected to a corresponding number of one-armed pivot levers 70, 71, 72, 73, 74, 75, 76, 77, 78, 79, 80, 81, 82, 83, 84, 85, 86, 87, 88, 89, 90, 91, 92 and 93 the ends 70*a*, 71*a*, 72*a*, 73*a*, 74*a*, 75*a*, 76*a*, 77*a*, 78*a*, 79*a*, 80*a*, 81*a*, 82*a*, 83*a*, 84*a*, 85*a*, 86*a*, 87*a*, 88*a*, 89*a*, 90*a*, 91*a*, 92*a* and 93*a* of which are provided with openings 100 (FIG. 8) for receiving a mounting rod 101 serving as a pivot axis. The mounting rod 101 is supported at its two ends 101*a*, 101*b* in respective bearing rods 102, 103 in a position above the drawer 30 and in a forward region of the housing 10. The bearing rods 102, 103 are arranged on either side of the drawer 30, are integral with the bottom wall 26 of the bottom member 21 and extend vertically of the bottom wall 26. The pivot levers 70 to 93 are individually pivotably mounted about this mounting rod 101. The mounting rod 101 may readily be removed together with the pivot levers 70 to 93. The guide bars 29, 29*a* along the bottom member 21 extend in the longitudinal direction of the drawer and serve concurrently as guide means for the outward movement of the drawer 30 or for proper inward movement of the drawer into the housing 10.

The free ends 70*a*, 71*b*, 72*b*, 73*b*, 74*b*, 75*b*, 76*b*, 77*b*, 78*b*, 79*b*, 80*b*, 81*b*, 82*b*, 83*b*, 84*b*, 85*b*, 86*b*, 87*b*, 88*b*, 89*b*, 90*b*, 91*b*, 92*b* and 93*b* of the pivot levers 70 to 93 are provided at their lower surfaces with card retainer pins 110, 111, 112, 113, 114, 115, 116, 117, 118, 119, 120, 121, 122, 123, 124, 125, 126, 127, 128, 129, 130, 131, 132 and 133. The arrangement of these card retainer pins 110 to 133 will be described further below.

The selector keys 50 to 63 define an array of six selector keys in each of four transverse rows A, B, C and D in corresponding columns *a*, *b*, *c*, *d*, *e* and *f*, as may best be seen from FIG. 1. Due to this arrangement of the selector keys 40 to 63 in rows and columns the keys require a rather restricted space so that the overall card register device may be of very small dimensions. The aperture 17 in the top cover plate 16 of the cover member 11 closely corresponds to the surface area covered or filled in by the array of selector keys 40 to 63.

Figure 8:
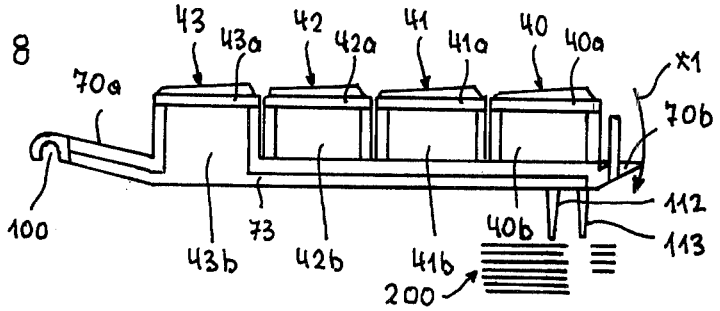
FIG. 8 is a lateral elevational view of four selector keys disposed in a column.
Figure 11:
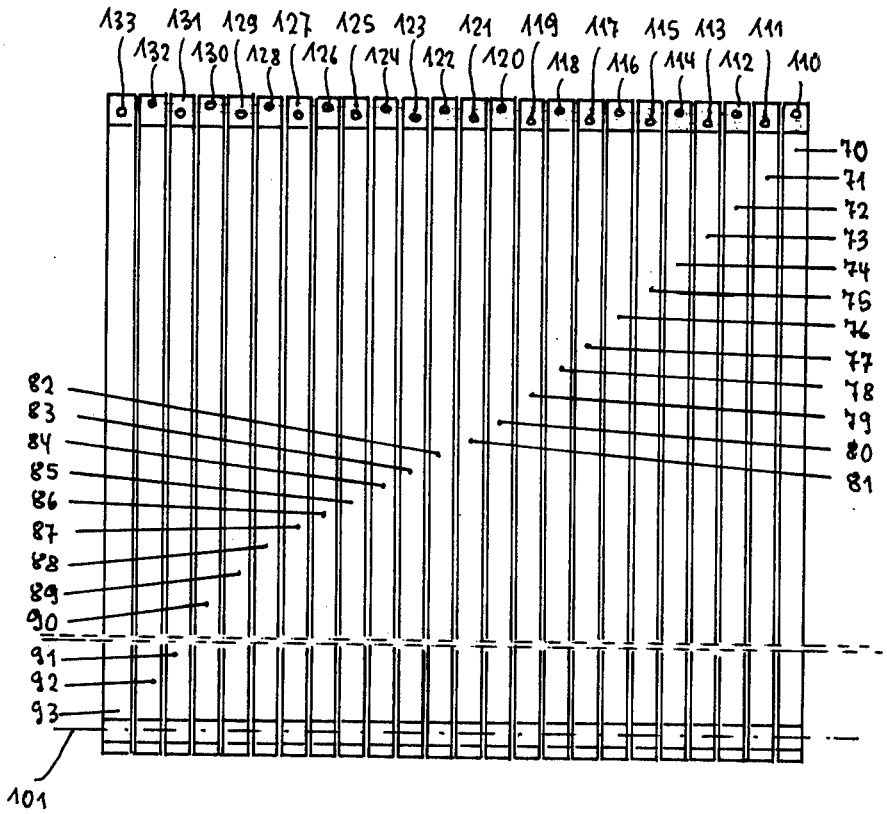
FIG. 11 is a bottom view of the pivot levers of the selector keys.
Figure 12:
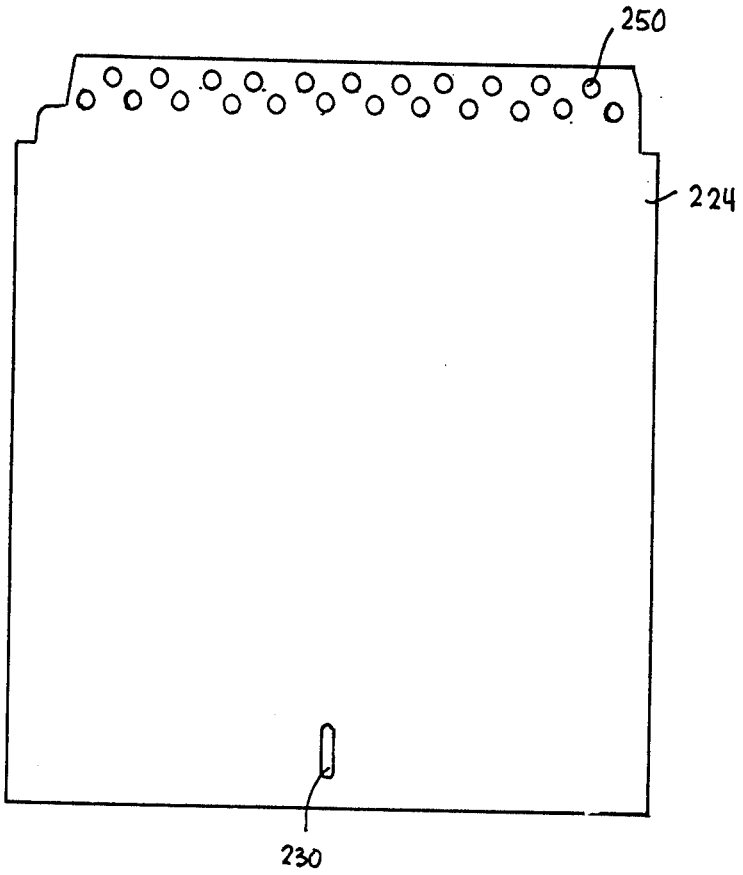
FIG. 12 is a top view of an index card.
Figure 13:
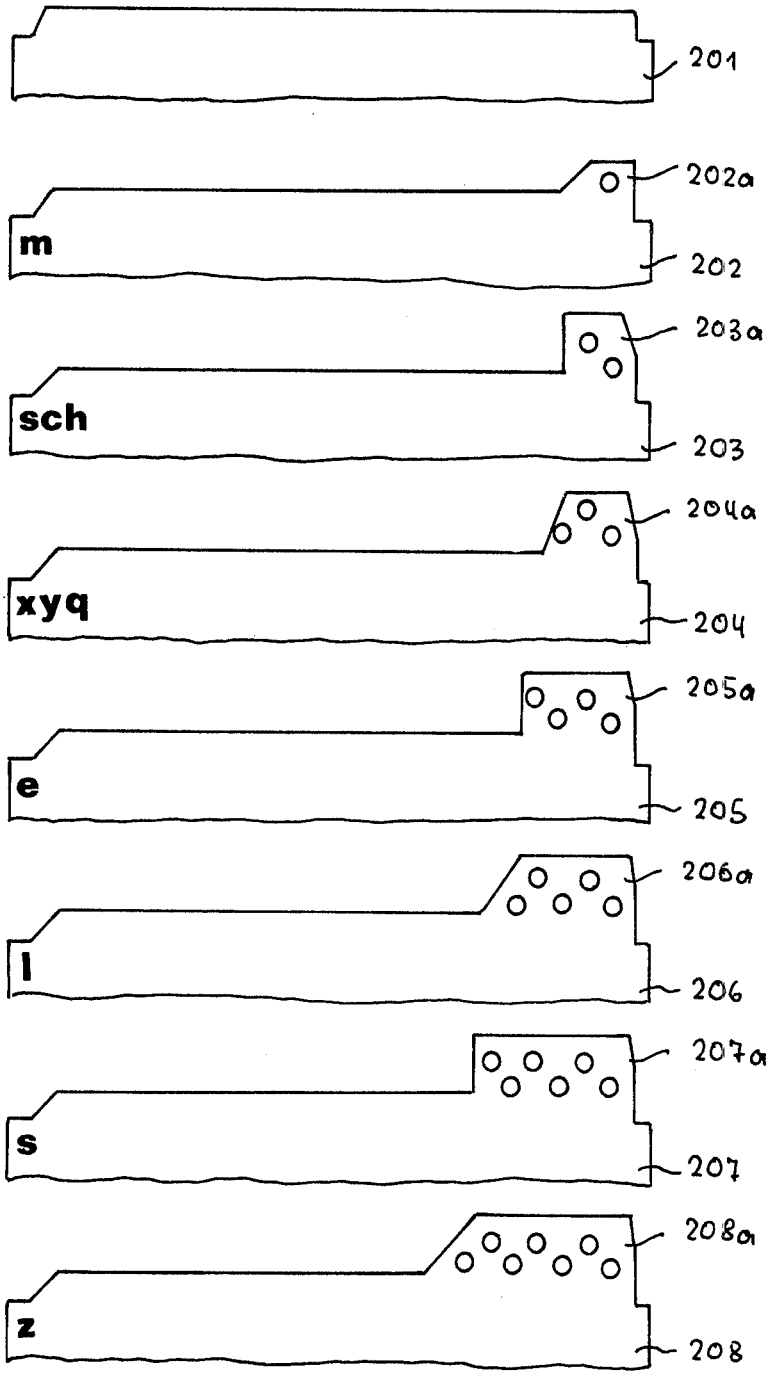
FIGS. 13, 13A and 13B are top views of the front portions of index cards disposed one behind the other and showing the aperture containing selector tongues in the rearward portions of the cards.
Figure 13A:
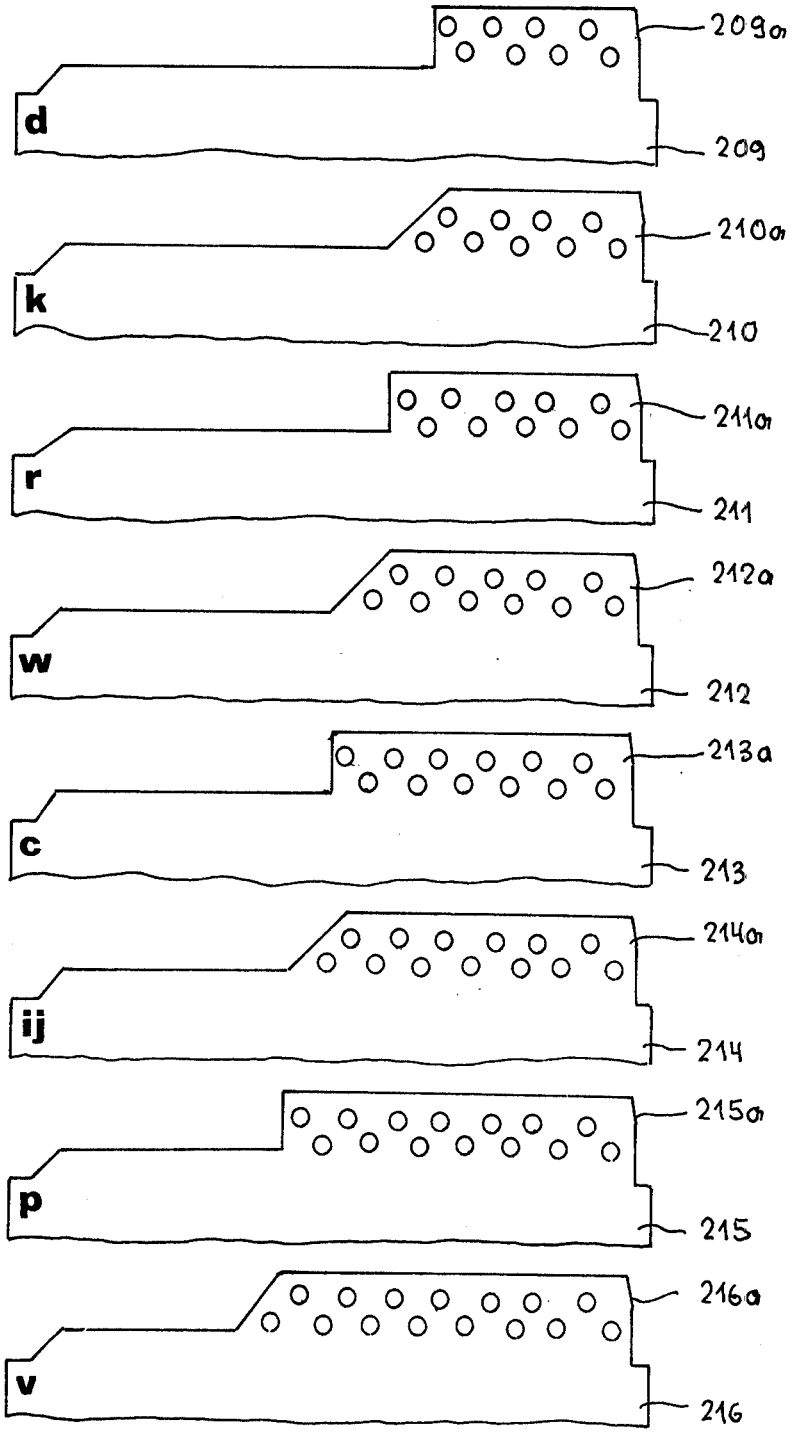
Figure 13B:
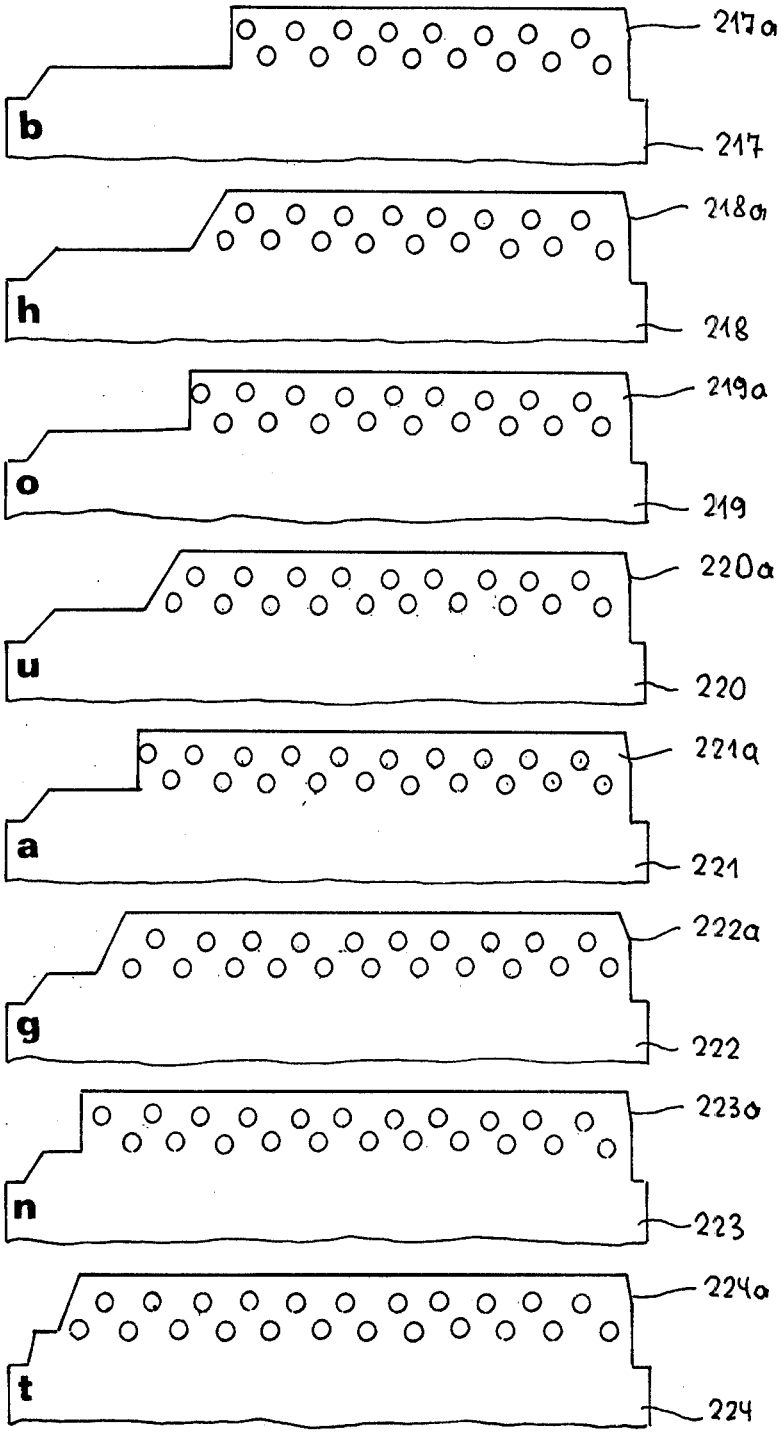

In order to allow a laterally closely packed arrangement of the pivot levers 70 to 93 in the housing 10, the selector keys are of a particular configuration and are arranged in a particular manner, as may be seen from FIGS. 8 to 10. This arrangement will be explained with reference to the four selector keys 40, 41, 42 and 43 that are disposed in the vertical column *a*. These four selector keys 40 to 43 consist, as likewise the remaining selector keys 44 to 63, of pad-shaped members 40*a*, 41*a*, 42*a*, 43*a* that are connected by a web 40*b*, 41*b*, 42*b*, 43*b* respectively to an associated pivot lever 70, 71, 72, 73 respectively. In the arrangement of the selector keys 40, 41, 42, 43 the pad-shaped member 40*a* of the selector key 40 at the pivot lever 73 is cantilevered toward the left hand side, and the pad-shaped member 43*a* of the selector key 43 at the pivot lever 70 is cantilevered toward the right hand side (as shown in the drawing) whereby the pad-shaped member 40*a* is connected at the rear end of the pivot lever 73, and the pad-shaped member 43*a* of the selector key 43 is connected to the end of the pivot lever 70 facing the bearing rod 102 (see also FIGS. 9 and 10). The pad-shaped members 41*a*, 42*a* of the selector keys 41, 42 that are disposed between the two outer selector keys 40 and 43 are connected with the pivot levers 72, 71 respectively in a manner so that the pad-shaped members 41*a*, 42*a* are cantilevered along both sides but along different lengths. The cantilevered portion of the pad-shaped member 40*a* of the selector key 40 is of a width corresponding substantially to the width of three pivot levers 73, 72, 71. Analogously the cantilevered portion of the pad-shaped member 43*a* of the selector key 43 is of a width substantially corresponding to the width of the three pivot levers 71, 72 and 73. The pad-shaped member 41*a* is connected to the pivot lever 72 in a manner so that the pad-shaped member 41*a* is cantilevered toward the selector key 40 by the width of the pivot lever 73, whereas the portion of the pad-shaped member 41*a* of the selector key 41 facing the selector key 42 is of a width substantially corresponding to the width of the pivot levers 71, 70. The selector key 41 is, similarly to the selector key 41, connected to the pivot lever 72. The portion of the pad-shaped member 42*a* of the selector key 42 facing the selector key 41 is of a width substantially corresponding to the width of the two pivot levers 72, 73, and the cantilevered portion of the pad-shaped member 42*a* facing the selector key 43 is of a width substantially corresponding to the width of the pivot lever 70. Due to this arrangement, four selector keys 40, 41, 42 and 43 may be arranged one behind the other in a column since every pad-shaped member 40*a*, 41*a*, 42*a* and 43*a* of the selector keys 40, 41, 42, 43 is of a width corresponding to the width of four pivot levers 73, 72, 71 and 70 respectively. The selector keys of the columns *b*, *c*, *d*, *e*, and *f* are analogously designed and are connected to their associated pivot levers, with the result that a plurality of selector keys may be accommodated within a minimum of space.

As may be seen from FIG. 8, the card retainer pins 110 to 133 arranged at the free ends 70*b* to 93*b* of the pivot levers 70 to 93 are arranged in two rows whereby the card retainer pins of every other pivot lever define a row so that the card retainer pins 111, 113, 115, 117, 119, 121, 123, 125, 127, 129, 131, 133 define a first row and the card retainer pins 110, 112, 114, 116, 118, 120, 122, 124, 126, 128, 130 and 132 define a second row. Every row of card retainer pins thus comprises twelve pins. The card retainer pins 110 to 133 are arranged at the lower surfaces of the pivot levers 70 to 93 and may be made of metal or a suitable plastic material. Alternatively, the pivot levers may be made integrally with the card retainer pins.

Figure 6:
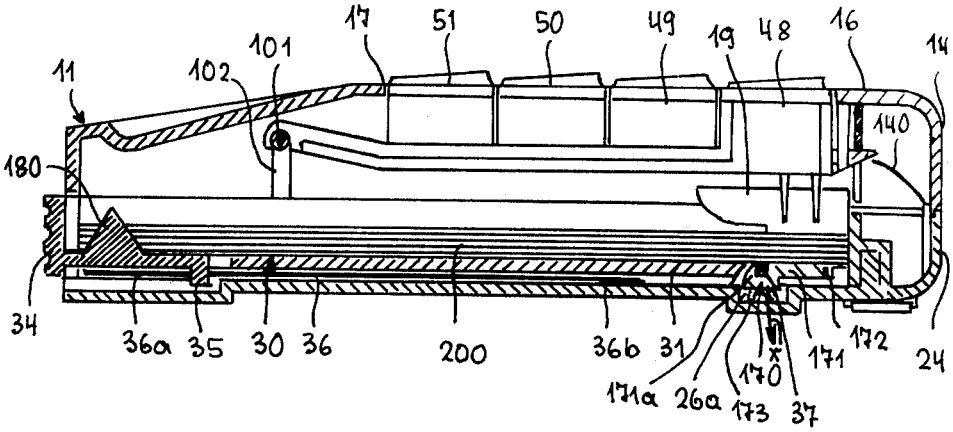
FIG. 6 is a vertical sectional view along the line VI—VI of FIG. 1.

The pivot levers 70 to 93 are supported at their free ends 70*b* to 93*b* on resilient tongues 140, 141, 142, 143, 144, 145, 146, 147, 148, 149, 150, 151, 152, 153, 154, 155, 156, 157, 158, 159, 160, 161, 162 and 163. These resilient tongues 140 to 163 are integrally moulded at the rear wall 25 of the bottom member 21 so that the pivot levers 70 to 93 assume a position in which the free ends of the card retainer pins 110 to 133 are above the stack of index cards 200 (FIG. 6).

A drawer locking mechanism 170 for locking the drawer 30 in an inward position within the housing 10 consists of the lug 37 at the bottom wall 31 of the drawer 30 and a drawer detent bar 171 that is rotatably mounted about a horizontal axis 172 in the region of the bottom wall 26 of the bottom member 21. The drawer detent bar 171 is mounted so that the forward portion 171*a* of the drawer detent bar 171 is rotatably movable in the direction of the arrow X toward a resilient element 173, and is adapted to be returned into its initial position (FIG. 6) by this resilient element 173. The resilient element 173 may consist of a spring, a foam rubber pad or the like. Preferably, the drawer detent bar 171 exhibits resilient properties. As may be seen in FIG. 6, the drawer detent bar 171 is arranged in the region of an opening 26*a* in the bottom wall 26 of the bottom member 21 and is of a length corresponding to the width of the drawer or respectively to the width of the pivot levers 70 to 93 carrying the card retainer pins 110 to 133. When actuating any of the selector keys 40 to 63, the associated card retainer pin is moved downwardly by its associated pivot lever and will engage the drawer detent bar 171. The drawer detent bar 171 is therefore urged at its forward end 171*a* into the opening 26*a* in the bottom wall 26 of the bottom member 21.

The drawer detent bar 171 includes a central trough-shaped depression 174 that extends into the path of movement of the lug 37 of the drawer 30. An upright retaining cam 175 is moulded along the drawer detent bar 171 in the region of the trough-shaped depression 174. The drawer detent bar 171 may be made of a plastic material of the same or of a different type as the housing 10. The overall design characteristics of the index card register are as follows: When moving the drawer 30 inwardly into the bottom member 21 of the housng 10, the lug 37 at the drawer 30 embraces the cam 175 whereby the drawer detent bar 171 assumes an approximately horizontal position or a position in which the forward portion 170*a* of the drawer detent bar 171 is in an upper position. This upper position of the rearwardly mounted drawer detent bar 171 will be assumed when the forward region 171*a* of the drawer detent bar 171 comes to rest above the recess 26*a* in the bottom wall 26 of the bottom member 21. The drawer detent bar 171 is arranged in the region of the path of movement of the card retainer pins 110 to 133. When actuating a selector key, the associated pivot lever connected to the actuated selector key will be rotated, with the result that the card retainer pin bearing free end of the pivot lever will be moved downwardly in the direction of the arrow $x_1$ (FIG. 8) so that the corresponding card retainer pin engages the forward region 171*a* of the drawer detent bar 171 and urges the drawer detent bar at its forward portion into the opening or recess 26*a* of the bottom wall 26 of the bottom member 21. Thereby the resilient element 173 will be compressed and biased. At the moment in which the card retainer pin has urged the forward portion 171*a* of the drawer detent bar 171 into the recess or opening 26*a* of the bottom wall 26 of the bottom member 21 the drawer 30 will be unlocked insofar as the cam 175 is rotated outwardly from the lug 37 connected to the drawer 30. Since the drawer 30 is spring-biased, the drawer 30 will be moved outwardly in this moment (FIGS. 5 and 6). Alternatively, the drawer detent bar 171 may be replaced by a device of a different design, and such a device must in any case permit to unlock the drawer 30 from the bottom member 21. When the bottom wall 36 of the bottom member 21 is of a sufficient thickness the opening 26*a* in the bottom wall 26 may be replaced by a recess. It is important, however, that for unlocking the drawer the drawer detent bar 171 may be urged, with its forward portion 171*a*, into an opening or a recess so that the unlocking operation may be initiated.

The stack of index cards 200 consists of a number of index cards made of heavy grade paper, cardboard or the like, the number of index cards corresponding to the number of selector keys 40 to 63. In the embodiment of the index card register shown in the drawings there are provided twenty four index cards, designated by the reference numerals 201, 202, 203, 204, 205, 206, 207, 208, 209, 210, 211, 212, 213, 214, 215, 216, 217, 218, 219, 220, 221, 222, 223 and 224. At the rear edge of the index cards 202 to 224 is provided a selector tongue 202*a*, 203*a*, 204*a*, 205*a*, 206*a*, 207*a*, 208*a*, 209*a*, 210*a*, 211*a*, 212*a*, 213*a*, 214*a*, 215*a*, 216*a*, 217*a*, 218*a*, 219*a*, 220*a*, 221*a*, 222*a*, 223*a* and 224*a* respectively, and in these selector tongues are provided apertures 250. These apertures 250 in the selector tongues of the index cards are arranged in two parallel rows which correspond to the arrangement of the card retainer pins 110 to 133 so that each aperture is operatively associated with a card retainer pin. The apertures 250 in the index cards 202 to 224 are of a substantially circular configuration. The lowermost index card 201 is devoid of apertures 250.

The configuration and the arrangement of the selector tongues 202*a* to 224*a* are as follows: Commencing with the index card 202 at the bottom the number of apertures 250 in each overlying index card increases by one aperture. Thus the index card 203 overlying the index card 202 with one aperture 250 includes two apertures 250 (FIGS. 15 – 18). Furthermore, the selector tongues are arranged so that the incremental aperture by which the number of apertures in any of the index cards is augmented with respect to the number of apertures in the adjacent underlying card is neither covered by a selector tongue nor by an aperture in any other index card. FIG. 15 illustrates a portion of the index card 202 with its selector tongue 202*a* that bears a single aperture 250*a*. The selector tongue 202*a* includes an oblique left hand side edge 202*b* whereby the configuration of the selector tongue 202*a* is such that the selector tongue may just accommodate the aperture 250*a*. The index 203 overlying the index card 202 includes a selector tongue 203*a* of approximately square or rectangular configuration in which are arranged two apertures 250*a* and 250*b* whereby the aperture 250*a* of the index card 203 coincides with the aperture 250*a* of the index card 202 when the two index cards overlie each other (FIG. 16). When the two index cards 202 and 203 overlie each other, the selector tongue 203*a* of the index card 203 covers the selector tongue 202*a* of the index card 202 to such an extent that only the selector tongue 202*a* is covered whereas the remaining portion 203*b* of the selector tongue 203*a* is exposed (FIGS. 17 and 18). When actuating the corresponding selector key the card retainer pin associated therewith is inserted through the aperture of the selector tongue 203*a* of the index card 203 and engages the drawer detent bar 171. The card retainer pin retains the index card 203 and any further index cards that overlie the index card 203. Since no card retainer pin is inserted through the aperture 250*a* of the selector tongue 202*a*, the index card 202 will not be retained but will move forward together with the outwardly moved drawer 30.

The entrainment of the selected index card or respectively of the selected index card and any index cards underlying the selected index card is ensured by means of a cam 180. This cam 180 is centrally moulded at the bottom wall 31 of the drawer 30 adjacent the drawer front wall 34. The index cards 201 to 224 include at their forward ends an aperture 230 each into which the cam 180 engages. When the drawer 30 moves outwardly from the housing 10, the selected index card, together with any underlying index cards, will be drawn from the stack of cards by this entrainment cam. This entrainment cam 180 is of an approximately triangular configuration which ensures that all of those index cards that are not being retained by a card retainer pin inserted through the apertures 250 may thus be released from the cam 180 so that only the liberated index card together with the underlying index cards will move outwardly together with the drawer.

The selector tongues 202*a* to 224*a* of the index cards 202 to 224 are arranged in a pattern that resembles a flight of stairs, as may be seen from FIG. 14.

The operation of the inventive index card register is briefly as follows: During periods of non-usage the drawer 30 is inserted into the housing 10. The drawer 30 accommodates a number of index cards that are overlying each other in a stack of index cards 200. The index cards include, at their rear edge, selector tongues. Each index card is provided with one selector tongue. In these selector tongues are provided apertures 250. When actuating a selector key, the pivot lever connected to this actuated selector key will be moved, at its free end, toward the bottom wall 26 of the bottom member 21 whereby the card retainer pin depending from this pivot lever is inserted through the operatively associated apertures 250 of the index cards arranged in its path of movement so that the pin engages the drawer detent bar 171. The forward portion 171*a* of the drawer detent bar 171 will thereby be urged into the opening or recess 26*a* in the bottom wall 26 of the bottom member 21. At this moment is released the lug 37 of the drawer 30 which had previously be retained by the cam 135 of the drawer detent bar 171. Upon rotation of the drawer detent bar 171 the cam 175 is withdrawn from the lug 37 by a rotary movement. In this instance the drawer 30 is accelerated forwardly by the compression spring (not shown) and concurrently entrains the selected index card and all index cards underlying the selected index card whereas all index cards overlying the selected index card are being retained by the depressed card retainer pin. When the projecting drawer with with corresponding index card exposed to sight is no longer required, the drawer 30 may be moved back into the housing 10 and will be retained therein by the fact that the lug 37 at the drawer bottom wall 31 engages the cam 175 and is being retained in the locking position by the drawer detent bar 171. When releasing the actuating pressure of the card retainer pin on the drawer detent bar 171, the latter is moved backwardly by the resilient element 173 into the slightly raised position, i.e. into a position ensuring engagement of the lug 37 on the drawer 30 with the cam 175 of the drawer detent bar 171, for interlocking these members. In the inserted position of the drawer 30, the index cards in the stack of index cards 200 are retained by the angled retaining ledges 19, 19*a* disposed internally of the housing 10 and partly overlapping laterally the index cards of the stack of index cards 200 so that the index cards and their selector tongues assume a flat planar shape in the region of the card retainer pins.

The index card register of the present invention may be designed and manufactured at low cost, and this is partly due to the fact that the selector keys 40 to 63 define together with their associated pivot levers 70 to 93 an assembly that may readily be removed since the pivot levers 70 to 93 are merely slided, at their one ends, onto the mounting rod 101. Any malfunction or wrong selection is excluded since only those index cards will be released for which the associated selector key has been actuated. Since the selector tongues having the apertures are arranged at the rear ends of the index cards, a relatively large portion of the index card surface is available for receiving indicia, data or the like. The entrainment cam 180 on the bottom wall 31 of the drawer 30 may also be replaced by laterally arranged entrainment cams. The index cards would then have to include correspondingly shaped recesses for engagement with these lateral entrainment cams whereby it must be ensured that the selected index card together with any underlying index cards are properly entrained when the drawer 30 moves outwardly from the housing, and that the index cards that are retained by the card retainer pin are released from the entrainment cams. For inscribing the index cards the latter may readily be removed individually from the card register housing.

The present invention is not intended to be restricted to the above described and illustrated embodiment. Modifications in the arrangement of the guide means for the drawer, in the arrangement of the resilient tongues biased by the card retainer pins and in the arrangement of the drawer locking and unlocking mechanism are likewise considered to be within the scope of the present invention. Thus the drawer detent bar may consist of a resilient tongue made of a plastic material moulded integrally with the bottom member of the housing. Due to its inherent restoring capacity such a resilient tongue will again return into its initial spatial position when releasing a pressure force applied to this tongue by a card retainer pin so that the drawer may be locked. There may likewise be provided a drawer locking mechanism of a different design. Thus the front edge of the drawer detent bar may be provided with a vertical engaging bar, and the drawer may be provided, at its rear bottom wall portion, with a wedge-shaped landing surface having a rearward vertical portion behind which engages the engaging bar of the drawer detent bar to retain the drawer in the inward position. The drawer detent bar may also be in the form of a key-bolt provided with suitable means for locking the drawer.

The index card register may be employed not only for presenting phone numbers, addresses and the like but likewise for tabulating or classifying goods of any type and the like.

The embodiments of the present invention in which an exclusive privilege or property is claimed are defined as follows:

1. An index card register with selector means, including a housing consisting of a cover member and a bottom member, a plurality of counter spring-biased selector keys, a drawer biased by a compression spring and adapted to be locked by a locking mechanism, a plurality of index cards defining a replaceable stack of index cards accommodated within the drawer, the index cards including marginal cutouts, means for unlocking the drawer and exposing to sight an index card selected by actuation of a corresponding selector key, by unlocking the drawer and moving the same into a position projecting from the housing under the bias of the compression spring, the drawer including entrainment cams of a resilient material adapted to engage entrainment apertures of the index cards, the index cards including selector apertures adapted to be engaged by the counter-spring-biased selector keys, said index card register being characterized by the plurality of selector keys being arranged in an array in several rows and columns on the cover member, each selector key being mounted on one end of an associated one-armed pivot lever, the other end of said pivot lever being rotatably journalled on a mounting rod serving as a pivot axis, the mounting rod being disposed in a forward region of said housing, said pivot lever being held in a substantially horizontal position by resilient means and includes, at its free end, a card retainer pin depending downwardly toward the bottom wall of said housing bottom member, said card retainer pins of said pivot levers being arranged in two rows along the lower surfaces of said pivot levers whereby the card retainer pins of every other pivot lever define a row; a drawer detent bar resiliently mounted in a rearward region of said bottom wall of said housing bottom member, said drawer detent bar including a drawer locking mechanism adapted to be unlocked to permit outward movement of said drawer when being biased by the card retainer pin of a depressed selector key; selector tongues bearing said selector apertures for said card retainer pins along rearward marginal portions of said index cards disposed in a stack within said drawer, said selector tongues increasing in extension by step-like increments from a lowermost index card having one aperture up to an uppermost index card having a highest number of apertures, from a bottom right hand position to a top left hand position, the number of apertures in said selector tongues increasing from the lowermost index card to the uppermost index card by one for each card, whereby the incremental one aperture in each index card as compared to the apertures in an adjacent underlying index card is exposed with respect to the aperture-containing selector tongue portions of an adjacent underlying index card; and a triangular entrainment cam in a forward region of said drawer, said entrainment cam adapted to cooperate with entrainment apertures in a forward region of said index cards.

2. An index card register as defined in claim 1 wherein means for supporting the free ends of said card retainer pins depending from the free ends of said pivot levers in a position above the uppermost index card in the stack of index cards and thereby above the apertures of the index cards consist of a plurality of resilient tongues mounted at the rear wall of said housing bottom member, the pivot levers being supported at their free ends by these tongues.

3. An index card register as defined in claim 1 wherein said drawer locking mechanism includes said drawer detent bar disposed in the path of movement of said drawer, said drawer detent bar being pivotably mounted about a horizontal pivot axis in the vicinity of the rear wall of said housing bottom member, a forward portion of said drawer detent bar being movable in an aperture, a recess or the like in the bottom wall of said drawer, said drawer detent bar being resilient and adapted to be retained in a locking position and further includes a central retaining cam in the landing region of said drawer, and a lug in a bottom rear portion of said drawer, said lug being adapted to engage said retaining cam.

4. An index card register as defined in the preceding claim 1 wherein said selector keys consist of square or rectangular pads, each connected, by a vertical web, to an associated pivot lever.

5. An index card register as defined in the preceding claim 1 wherein the width of every of four selector keys disposed in a column corresponds substantially to the width of the four pivot levers supporting said selector keys.

6. An index card register as defined in claim 1 wherein said top cover plate of said housing cover member includes an aperture the size and dimensions of which substantially correspond to the area covered by the array of selector keys.

7. An index card register as defined in claim 1 wherein said drawer is adapted to be guided by lateral guide means in the housing bottom member.

8. An index card register as defined in claim 1 wherein retaining ledges partly overlying rear portions of said drawer and said stack of index cards inserted in said drawer are arranged in a rearward region of said housing bottom member.

9. An index card register as defined in claim 1 wherein said apertures in said selector tongues of said index cards are arranged in mutually coinciding positions and the selector tongues of every other index card include an oblique portion exposing an aperture in a selector tongue of an adjacent underlying index card.

10. An index card register as defined in the preceding claim 1 wherein four selector keys in a column are connected to their associated pivot levers in a manner whereby the rearward selector key is cantilevered toward the left side, and the forward selector key is cantilevered toward the right side with respect to its associated pivot lever, and the two intermediate selector keys are connected to their associated pivot levers in a manner whereby all of the four selector keys are aligned in a column.

11. An index card register as defined in claim 10 wherein the rearward selector key of four selector keys defining a column unit includes a portion cantilevered to the left, and the forward selector key includes a portion cantilevered to the right whereby each of said two cantilevered portions is of a width substantially corresponding to the width of three pivot levers, and the two selector keys disposed between said rearward and forward selector keys each include on one side a cantilevered portion of a width substantially corresponding to the width of a pivot lever, and on the other side a cantilevered portion of a width substantially corresponding to the width of two pivot levers.

* * * * *